US006604329B2

(12) United States Patent
Hoy et al.

(10) Patent No.: US 6,604,329 B2
(45) Date of Patent: Aug. 12, 2003

(54) LIGHT CONDUCTING TUBE FOR A SKYLIGHT

(75) Inventors: Walter S. Hoy, Huber Heights, OH (US); Gary F. Cunagin, Tipp City, OH (US); Mark W. Hopkins, Conover, OH (US)

(73) Assignee: Fox Lite, Inc., Fairborn, OH (US)

( * ) Notice: Subject to any disclaimer, the term of this patent is extended or adjusted under 35 U.S.C. 154(b) by 0 days.

(21) Appl. No.: 10/017,962

(22) Filed: Dec. 18, 2001

(65) Prior Publication Data

US 2002/0051297 A1 May 2, 2002

Related U.S. Application Data

(63) Continuation of application No. 29/114,189, filed on Nov. 19, 1999, now Pat. No. Des. 464,436.

(51) Int. Cl.[7] ..... E04B 7/18
(52) U.S. Cl. ..... 52/200; 52/22
(58) Field of Search ..... 52/200, 22, 171.3, 52/732.1, 726.1

(56) References Cited

U.S. PATENT DOCUMENTS 3,137,099 A * 6/1964 Wasserman ..... 52/200
5,016,406 A * 5/1991 Calam et al. ..... 52/58
D382,347 S 8/1997 Grubb
5,806,255 A * 9/1998 Verby et al. ..... 52/200
RE36,496 E 1/2000 Sutton
6,067,759 A * 5/2000 House ..... 52/198
6,219,977 B1 4/2001 Chao et al.
6,256,947 B1 7/2001 Grubb
6,363,667 B2 * 4/2002 O'Neill ..... 52/200

* cited by examiner

*Primary Examiner*—Carl D. Friedman
*Assistant Examiner*—Jennifer I. Thissell
(74) *Attorney, Agent, or Firm*—Jacox, Meckstroth & Jenkins

(57) ABSTRACT

An elongated open ended tube has a square or rectangular cross-section and light reflecting inner surfaces. The tube is formed with flat semi-rigid side walls flexibly connected at the corners for collapsing or folding the tube between a generally flat storage and shipping position and an expanded tubular position for installation. The tube extends within an attic of a building with its upper open end portion covered by a light transmitting skylight attached to the roof of the building and its lower open end portion covered by a light transmitting and diffusing panel or lens attached to a ceiling of the building.

13 Claims, 3 Drawing Sheets

LIGHT CONDUCTING TUBE FOR A SKYLIGHT

RELATED APPLICATION

This application is a continuation of application Ser. No. 29/114,189, filed Nov. 19, 1999 now Des. 464,436 issued Oct. 15, 2002.

BACKGROUND OF THE INVENTION

This invention relates to tubular skylight assemblies, for example, as disclosed in U.S. Pat. Nos. 6,219,977, 6,256,947, Reissue No. 36,496 and Design Patent No. 382,347. Such tubular skylights are commonly installed within the attic of a home generally from an inclined roof covering to a flat horizontal ceiling with a cylindrical light reflecting tube or rotatably connected cylindrical tube sections extending between the roof and ceiling. The upper open end portion of the tube is covered by a light transmitting skylight usually formed of a plastics material and having an outwardly projecting flashing or flange which projects under the roof covering or shingles. The lower open end of the tubing is commonly covered by a light transmitting plastic panel or lens which is attached to the ceiling. A light conducting tube has also been constructed of a helically wound strip which is connected to provide a flexible tube having a circular cross-section and for accommodating a horizonatally offset condition between the roof rafters and the ceiling joists.

SUMMARY OF THE INVENTION

The present invention is directed to a new light conducting device or tube which is adapted for transmitting light from a skylight panel or lens mounted on the roof through a frame and panel or lens mounted on the ceiling. The tube has flat semi-rigid side walls which are connected by flexible or folding corners to provide for folding the tube between a generally flat collapsed position and an expanded tubular position having a square or rectangular cross-section. The side walls of the tube have inner light reflecting surfaces, and the size of the tube is selected to fit between the rafters and the joists. The collapsible tube may be constructed of different materials such as semi-rigid corrugated paperboard or semi-rigid plastic sheet material. The collapsible light conducting tube of the invention provides for not only a lower cost of construction, but is also easier to install and is light weight and compact for storage and shipment.

Other features and advantages of the invention will be apparent from the following description, the accompanying drawings and the appended claims.

DESCRIPTION OF THE PREFERRED EMBODIMENT

Figure 1:
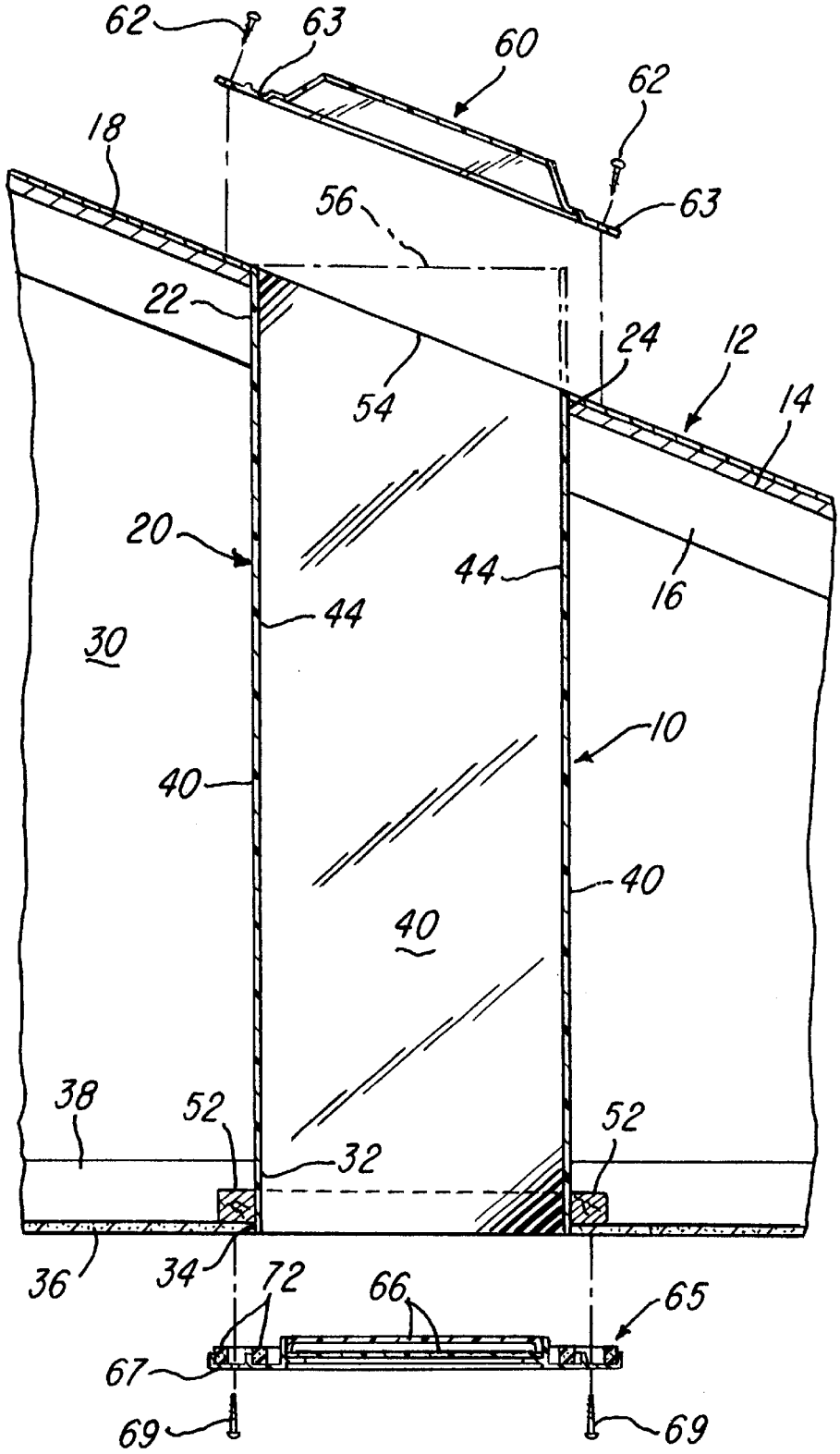
FIG. 1 is a vertical section through a skylight tube constructed in accordance with the invention and illustrating the tube installed within an attic of a house, and with a roof skylight panel or lens and ceiling panel or lens shown in exploded positions.
Figure 2:
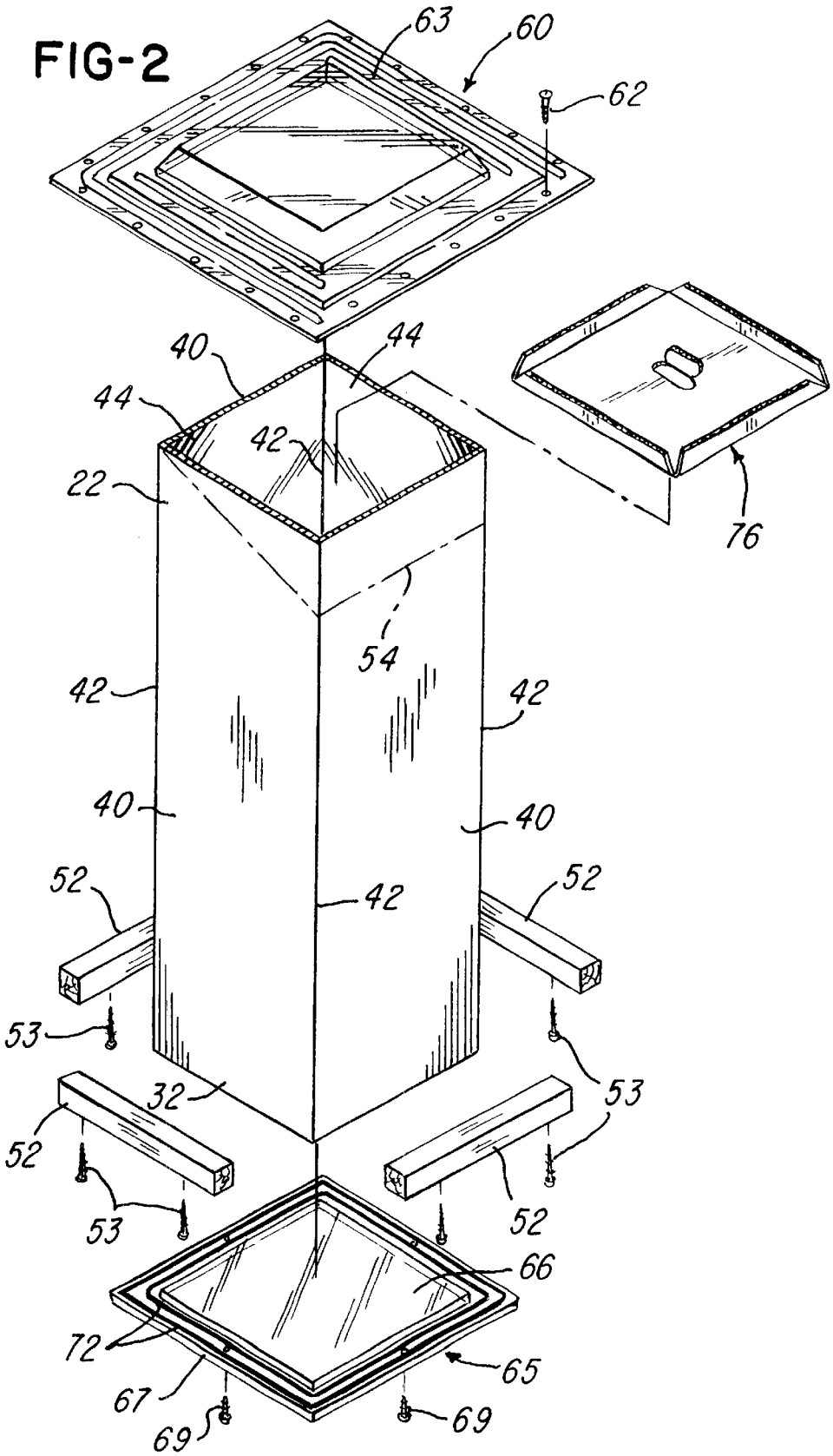
FIG. 2 is an exploded perspective view of the light conducting tube shown in FIG. 1, with the associated installation components also shown in exploded positions.

FIGS. 1 and 2 illustrate a tubular skylight assembly 10 which installs between a roof 12 having roof sheeting 14 supported by and attached to parallel spaced rafters 16 and covered by overlapping shingles 18 or another form of roof covering. The skylight assembly 10 includes a light conducting tube 20 constructed in accordance with the invention and having an upper open end portion 22 projecting through a square opening 24 cut within the roof sheeting 14 and roof covering 18. The tube 20 may extend vertically through an attic 30 of a house or other building structure and has a lower open end portion 32 extending through a square opening 34 within horizontal ceiling formed, for example, of drywall sheeting 36 attached to parallel spaced horizontal joists 38. While the tube 20 is shown square in horizontal cross-section, the tube may also be rectangular in cross-section.

Figure 3:
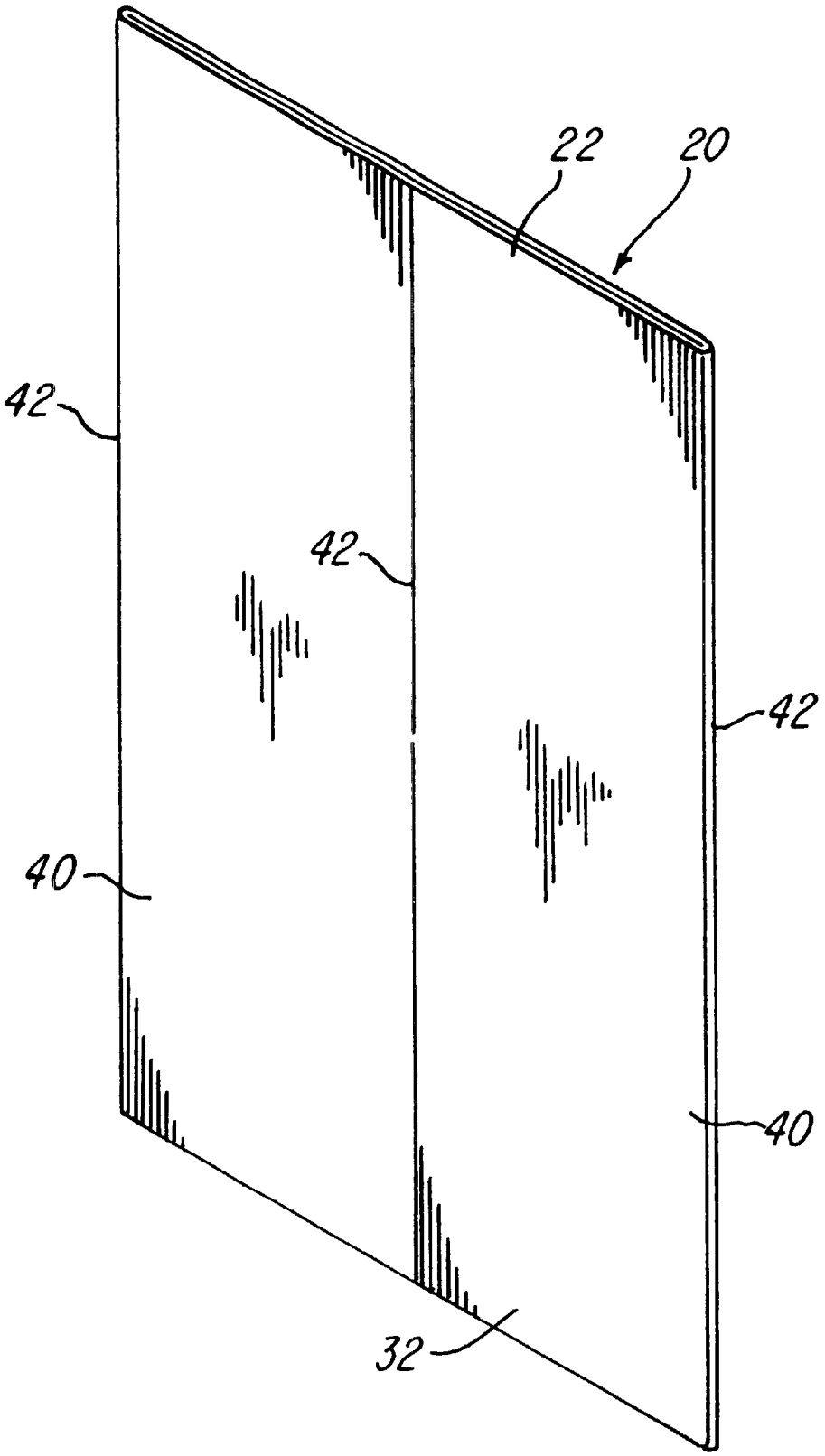
FIG. 3 is a perspective view of the light conducting tube of FIG. 2 and shown folded to its collapsed position.

As shown in FIG. 2, the square light conducting tube 20 has four flat side walls 40 which are connected by flexible folding corners 42 which form integral hinges. The flat side walls 40 have inner light reflecting surfaces 44, and the tube 20 is preferably formed of a semi-rigid sheet material such as a semi-rigid corrugated paperboard or a semi-rigid sheet plastics material, either of which is scored or creased along parallel lines to form the integral hinge or folding corners 42. The light reflecting inner surfaces 44 may be formed by a light reflecting paint or other material such as aluminum foil laminated to the side walls 40. The tube 20 may also be formed of a white sheet of plastics material which is extruded with parallel spaced thin skins integrally connected by longitudinally extending and parallel spaced thin webs. The inner white skin of the sheet forms the inner light reflecting surfaces 44, As mentioned above, the tube 20 may be square or rectangular in cross-sectional configuration, and the flexible corners or hinges 42 provide for folding the tube 20 between a generally flat storage and shipping position, as shown in FIG. 3, and the expanded tubular position as shown in FIGS. 1 and 2.

After the openings 24 and 34 are cut within the roof sheeting 14 and ceiling sheeting 36, respectively, a set of four wood strips 52 are attached to the top surface of the ceiling sheeting 36 around the opening 34 by a set of screws 53. The expanded tube 20 is then installed within the openings 24 and 34, and the lower open end portion of the tube 20 is attached to the wood strips 52 by suitable fasteners such as nails, screws or staples. The upper open end portion 22 of the tube 20 is cut or trimmed along a line 54 corresponding to the pitch of the roof so that the upper end of the tube is substantially flush with the top surface of roof sheeting 14. The upper open end portion 22 of the tube 20 is attached to the roof sheeting 14 by suitable fasteners, such as nails, screws or staples, and a trimmed or removed portion 56 of the tube is discarded.

The upper open end portion 22 of the tube 20 is then covered by a skylight panel 60 which is preferably vacuum formed of a sheet plastics material, for example, as disclosed in U.S. Pat. No. 6,263,624 which issued to the assignee of the present invention. The skylight panel 60 is attached to the roof sheeting 14 by a set of screws 62 which extend through prepunched holes within an outwardly projecting flange portion 63 of the panel 60. The holes and screws are covered by the roof covering or shingles 18 along the top and side flange portions of the skylight panel. The lower open end portion 32 of the tube 20 is preferably covered by a light diffusing panel or lens 65 which preferably has double or dual textured plastic panes 66 carried by a molded plastic frame 67 attached to the ceiling sheeting 36 by a set of screws 69 extending into the wood strips 52. Preferably, resilient sealing strips or beads 72 are carried by the frame 67 and form a fluid-tight seal with the ceiling sheeting 36 so that cooler air within the tube 20 does not flow downwardly into the room below the ceiling sheeting 36 and warm humid air does not flow upwardly from the room into the tube 20 and condense on the panes 66. If desired, a formed fiberboard squaring tool 76 (FIG. 2) may be temporarily inserted into the tube 20 while it is being installed to insure that the tube remains square or rectangular with square corners. After the tube 20 is installed as shown in FIG. 1, the squaring tool 76 is removed.

From the drawings and the above description, it is apparent that a skylight tube constructed in accordance with the present invention, provides desirable features and advantages. For example, the skylight tube reduces the number of parts in a tubular skylight assembly and significantly reduces the time required for installing a tubular skylight assembly. The skylight tube is also light weight and more economical in construction, and the square or rectangular cross-sectional configuration conducts or transmits substantially more light than a tube of circular cross-section and having a diameter equal to the width of a side wall 40 of the tube 20. The collapsible light weight skylight tube is also desirable for handling, storage and shipping.

While the form of collapsible skylight tube herein described constitutes a preferred embodiment of the invention, it is to be understood that the invention is not limited to this precise form, and that changes may be made therein without departing from the scope and spirit of the invention as defined in the appended claims.

What is claimed is:

1. In a building structure having an inclined roof spaced above a horizontal ceiling, a device for conducting natural light from said roof to said ceiling, comprising an elongated tube having generally flat side walls with inner surfaces, said side walls connected by four longitudinally extending flexible corners to provide for folding said tube between a generally flat collapsed position and an expanded tubular position, said tube having a lower open end portion connected to said ceiling, and said tube having an upper open end portion connected to said roof.

2. A device as defined in claim 1 wherein said tube comprises a sheet of material having parallel flexible hinge portions forming said corners of said tube and integrally connecting adjacent said side walls.

3. A device as defined in claim 1 wherein said side walls of said tube have inner light reflecting surfaces.

4. A device as defined in claim 1 wherein said tube has a square cross-sectional configuration in said expanded position.

5. A device as defined in claim 1 wherein said tube has a rectangular cross-sectional configuration in said expanded position.

6. A device as defined in claim 1 wherein said tube has square corner portions in said expanded position.

7. A device as defined in claim 1 wherein said tube has a predetermined length and width, and said length is substantially greater than said width of said tube.

8. In a building structure having an inclined roof spaced above a horizontal ceiling, a device for conducting natural light from said roof to said ceiling, comprising an elongated tube having generally flat side walls with inner light reflecting surfaces, said side walls connected by four longitudinally extending flexible corners to provide for folding said tube between a generally flat collapsed position and an expanded tubular position, said tube having a lower open end portion connected to said ceiling, said tube having an upper open end portion connected to said roof, a light transmitting skylight panel covering said upper open end portion of said tube, and a light transmitting lens covering said lower open end portion of said tube.

9. A device as defined in claim 8 wherein said tube comprises a sheet of material having parallel spaced and flexible hinge portions forming said corners of said tube and integrally connecting adjacent said side walls.

10. A device as defined in claim 8 wherein said tube has a square cross-sectional configuration in said expanded position.

11. A device as defined in claim 8 wherein said tube has a rectangular cross-sectional configuration in said expanded position.

12. A device as defined in claim 8 wherein said tube has a predetermined length and width, and said length is substantially greater than said width of said tube.

13. A device as defined in claim 8 in combination with a skylight of light transmitting material and adapted to be mounted on the roof over said upper open end portion of said tube.

* * * * *